United States Patent [19]

de Hek

[11] Patent Number: 4,478,688

[45] Date of Patent: Oct. 23, 1984

[54] PROCESS OF MANUFACTURING SCREEN MATERIAL

[75] Inventor: Johan A. de Hek, Arnhem, Netherlands

[73] Assignee: Veco Beheer B.V., Netherlands

[21] Appl. No.: 521,386

[22] Filed: Aug. 8, 1983

Related U.S. Application Data

[63] Continuation-in-part of Ser. No. 306,246, Sep. 28, 1981, Pat. No. 4,397,715.

[30] Foreign Application Priority Data

Sep. 30, 1980 [NL] Netherlands ..... 8005427

[51] Int. Cl.³ ..... C25D 1/08; C25D 5/08

[52] U.S. Cl. ..... 204/11; 204/24

[58] Field of Search ..... 204/11, 24

[56] References Cited

U.S. PATENT DOCUMENTS

| | | | |
|---|---|---|---|
| 2,226,381 | 12/1940 | Norris | 204/11 |
| 2,226,384 | 12/1940 | Norris | 204/11 |
| 2,260,893 | 10/1941 | Ewing | 204/9 |
| 3,424,667 | 1/1969 | Frank | 204/24 |

FOREIGN PATENT DOCUMENTS

| | | | |
|---|---|---|---|
| 1199404 | 7/1970 | United Kingdom | 204/11 |

OTHER PUBLICATIONS

Modern Electroplating, Edited by F. A. Lowenheim, Third Edition, 1974, pp. 296–305.

Plating and Surface Finishing, Dec. 1979, pp. 36–38.

*Primary Examiner*—Thomas Tufariello

*Attorney, Agent, or Firm*—Ostrolenk, Faber, Gerb & Soffen

[57] ABSTRACT

In a process of manufacturing screen material a metal matrix is subjected to an electrolytic metal deposition by using an electrolytic bath containing a brightener, the liquid of the bath being forced to flow through apertures in the anode toward the cathode. The metal deposits grow substantially perpendicular to the lands of the matrix and thus a screen is formed having apertures of approximately the same size as the apertures of the original matrix. The screen can be removed from the matrix by previously coating the latter with a separating agent such as beeswax.

17 Claims, 10 Drawing Figures

PROCESS OF MANUFACTURING SCREEN MATERIAL

This is a continuation-in-part of U.S. application Ser. No. 306,246, filed Sept. 28, 1981 now U.S. Pat. No. 4,397,715.

BACKGROUND OF THE INVENTION

1. Field of the Invention

The present invention relates to a process of electrolytically manufacturing screen material by depositing a metal upon a matrix in an electrolytic bath, the latter containing at least one brightener.

2. Description of the Prior Art

U.S. Pat. No. 2,226,384 entitled Process of electrolytically producing foraminous sheets, issued to Edward D. Norris on Dec. 24, 1940, describes a process of forming a screen by electrolytically depositing a metal upon a screen skeleton formed in a first stage. The screen formed by electrolytically depositing a metal on the screen skeleton can be removed, if required, by previously applying a stripping means, e.g. beeswax, to the screen skeleton. Evidently in that case the parts of the skeleton not belonging to the separating surface must be coated with an insulating mass preventing deposition of metal on these parts in order to avoid a complete surrounding of the skeleton by deposited metal.

The drawback of this known process is that during the electrolytic deposition the lands as present in the matrix or screen skeleton grow in all directions, so that the screen material as finally obtained presents small passages with lands of substantially circular cross-section.

SUMMARY OF THE INVENTION

In view of the foregoing factors and conditions of the prior art it is a primary object of the present invention to provide a process which does not have this drawback and in which more particularly, the growth of deposited metal on the matrix or screen skeleton is effected solely or practically solely in one or two directions perpendicular to the matrix so that the original dimensions of the apertures in the matrix or screen skeleton are fully maintained in the final screen.

With the process according to the invention, it is more particularly possible to produce metal screens with or without the incorporation of the matrix, which screens combine maximum passage with maximum strength in any degree of fineness as required in practice, the apertures in the screen material increasing in size only toward one side, so that, when they are used as filter medium, there is little risk of clogging, contrary to processes in which there is a growth of the matrix in every direction.

This object is attained according to the invention, in that the bath liquid is made to flow, at least during part of the electrolytic deposition, through the apertures in the matrix connected as a cathode solely from the anode towards the cathode.

More particularly it has been found that with said forced uni-directional flow of bath liquid through the apertures in the matrix it is possible, by using certain speeds of the liquid, to achieve a condition in which metal deposition from the electrolytic bath occurs solely or practically solely, in one or two directions perpendicular to the matrix so that the apertures do not become smaller.

The bath liquid is advantageously made to flow through the matrix at a speed of at least 0.005 m/sec., preferably of 0.05 to 1 m/sec. The flow is into the direction of the cathode and parallel to a perpendicular to the anode and cathode.

It has been found particularly that for a given speed of the liquid it is possible to adjust the cathode to a current density at which there is substantially no deposition of metal on the side of the matrix facing the anode.

Moreover it has surprisingly been found that it is not necessary to maintain the forced flow of liquid through the cathode for the entire period of the electrolytic deposition. The deposition of metal in the apertures of the matrix can already be prevented by applying a forced flow of liquid during just a very short time at the start of the electrolysis.

According to the process of the invention, optimum results are obtained when the electrolytic bath contains an organic compound containing at least one unsaturated bond not belonging to a

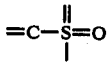

group, for example a butyne diol and ethylene cyanohydrine.

When these organic compounds are used in combination with the forced flow of liquid it is possible to prevent the apertures in the matrix from becoming smaller during the electrolytic deposition.

More particularly it has been found that the shape of the land produced during electrolysis by means of a process according to the invention is controlled almost entirely by the following parameters:

1. Quantity and type of organic compound used, more particularly a compound presenting the properties of a brightener of the second class of brighteners;
2. the current density on the cathode, and
3. the speed of the liquid through the apertures in the matrix.

Although it is not possible to satisfactorily explain the above effects it is assumed that the flow of liquid and the organic compound used or one or more decomposition products thereof, result, at those places where the speed of the liquid exceeds a specific value, in a boundary layer which cannot only prevent the deposition of metal, but also completely counteract it in the process according to the invention.

Within certain limits the required speed of the bath liquid through the apertures appears to be inversely proportional to the concentration of the said organic compound, more particularly a brightener of the second class or brighteners or compounds presenting similar properties.

It has additionally been found that with a given concentration of brightener and a given speed of the liquid it is possible to find at the cathode a current density at which occurs just no metal deposition on that side of the matrix facing the anode. With a constant concentration of said organic compound, the speed of the bath liquid being increased through the cathode-connected matrix from the anode, the current density on the cathode is also increased without there being any metal deposition on the side facing the anode. It will be clear that the formation of screens by a deposition of metal on just one side of a matrix is of great importance technologically.

It has been particularly found that the deposition of metal in the matrix apertures is completely prevented by a forced flow of liquid during a very short period of e.g. one minute or less, at the start of the electrolysis, which then lasts for a total period of 45 minutes, for example. During the remainder of the electrolysis the forced flow of liquid can be reduced or even completely stopped.

This effect can be used in order to obtain all kinds of required shapes of land sections in the matrix without the dimensions of the apertures becoming smaller than those of the matrix.

Depending upon the type of organic compound in the form of a second-class brightener, the desired effect in the form of total prevention of metal deposition in the plane of the matrix, by adapting the parameters in the form of current density and organic compound concentration, appears to occur at liquid speeds of 0.005 m/sec. as measured on the effective open surface of the matrix. From these calculations it appears that the Reynolds number in the aperture in the matrix is then much less than 2,100.

The process according to the present invention is generally carried out with electrolytic bath liquid speeds comprised between 0.05 and 1 m/sec.

Although the action of the organic compounds having second-class brightener presenting properties according to the invention is not restricted to nickel baths, most industrial applications are in the application of nickel and nickel alloys.

Any metal can be used for the matrix, e.g. copper, while stainless steel is excellent as a matrix material for the production of nickel screens. Obviously nickel can also be used as matrix, in which case a matrix is provided with a layer of beeswax as a stripping means in order to enable the resulting screen to be removed from the matrix at a later stage.

The present invention is also embodied in screen material, e.g. cylindrical screen material, obtained by using the process according to the invention.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF THE PREFERRED EMBODIMENTS

Figure 1:
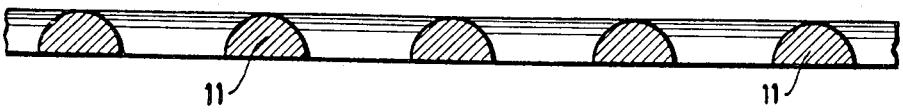
FIG. 1 is a matrix shown schematically.
Figure 2:
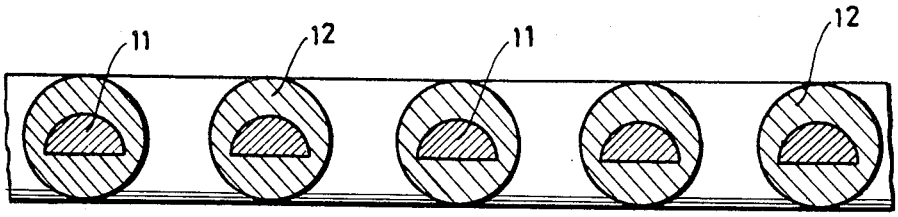
FIG. 2 is the final material obtained by electrolytic deposition of a metal in case of normal growth of the deposited metal in all directions, in accordance with the prior art.
Figure 3:
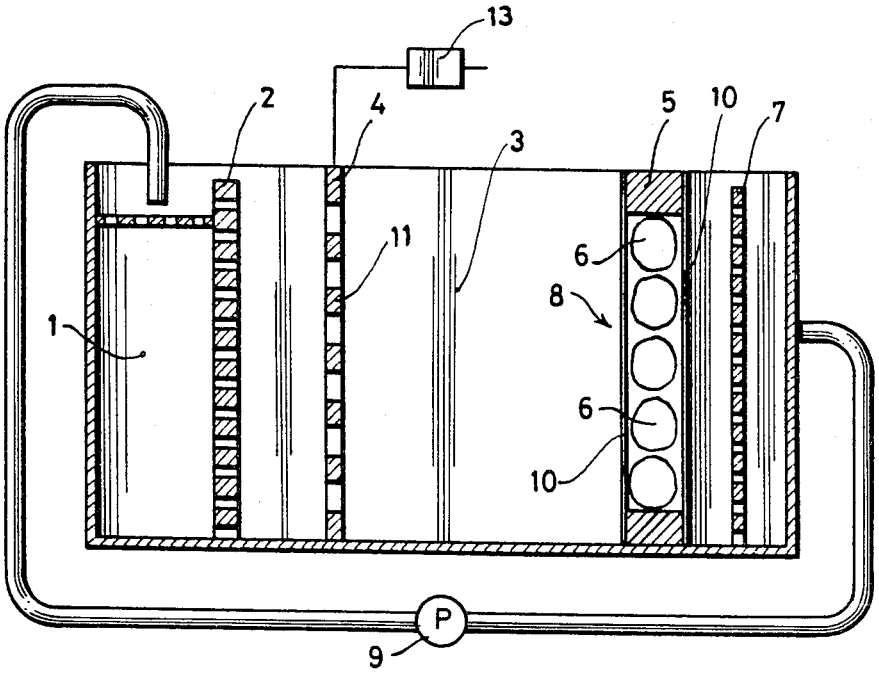
FIG. 3 is a vertical section through a bath for applying the process according to the invention.

Initially referring to FIG. 3 in an apparatus for executing the process according to the invention, it is possible to maintain a substantially constant speed of flow of the liquid in all the apertures of the cathode-connected matrix 11 in the electrolytic bath, even in the case of large surfaces of 1 $m^2$, for example.

To this end, the electrolytic bath is provided with a first chamber 1 to which the bath liquid is supplied in an evenly divided state, chamber 1 being separated from the cathode-anode chamber 3 by one or more perforated partitions 2, having a number of small apertures such, that there is only a slight pressure head difference required, e.g. 5 to 10 mm, in order to produce the required flow.

Advantageously, anode 8 comprises one or more flow passages so that the bath liquid can flow through the anode at uniform speed as considered over the entire area of the anode.

An anode 8 with a flow passing through it is manufactured, for example, by securing two pieces of titanium gauze 10 parallel to each other and parallel to the surface and cathode 11, which is to be treated as the matrix, and by filling the space between the two pieces of titanium gauze with small pieces of the required anode material 6.

In this way there is no disturbance of the required uniform flow of the bath liquid through the matrix arranged as cathode.

The forced flow of bath liquid is provided by pump 9.

If desired, it may be advantageous to separate the anode-cathode chamber by means of a perforated wall 7, and an overflow partition, which latter can, for example, be provided with a special weir to measure the quantity of circulating bath liquid.

To secure the cathode 11, a cathode fixing means 4 is provided, which can be connected to a cathode of an electric source.

The cathode fixing means 4 in this case acts as the cathode connecting element and the anode fixing means 5 as the anode connecting element.

The installation as shown may also be provided with a cathode current density adjustment and control means 13.

It will be obvious that in order to manufacture cylindrical screens, the flow will be in an appropriately adapted direction through a vertically disposed cylindrical matrix material; the anode will also be constructed in an appropriately adapted cylindrical shape. It is also possible to use a radial flow between the periphery of the cathode and the center, using an appropriate arrangement of the anode and the cathode.

In the case of a cylindrical matrix, it may also be advantageous to mount the same rotatably around a horizontal axis and to suspend it partially in the bath liquid.

The present invention will now be explained with reference to some examples.

EXAMPLE 1

A beeswax-coated nickel screen plate 11 is disposed vertically as the cathode in a known nickel bath, containing 80 mg of 2-butyne-1,4-diol per liter of bath liquid. The screen plate comprises apertures in the form of slots 120 $\mu$m in width.

A nickel anode 18 is disposed parallel to and at a distance of 60 mm from the cathode 11.

A pump 9 provides a flow of liquid such, that the bath liquid flows from the anode to the cathode through the screen plate apertures at a speed of 1 m/sec.

The d.c. current is 5 A/dm$^2$ measured on the total unilateral surface of cathode 11.

The bath liquid temperature is 60° C.

Figure 4:
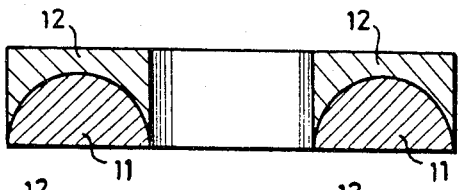
FIGS. 4 to 10 are different sections of screen material obtained by means of the process according to the invention.

After 60 minutes, the resulting end product has a land section as shown diagrammatically in FIG. 4. The nickel material as deposited can be removed in the form of a screen 12.

Under the same conditions as above, an identical portion of screen plate was used and the liquid speed was reduced to 0.16 m/sec.

Figure 5:
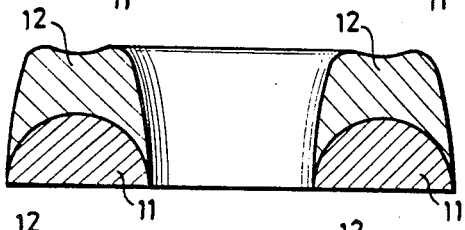

After 60 minutes the resulting end product had a section as shown schematically in FIG. 5.

EXAMPLE II

Figure 6:
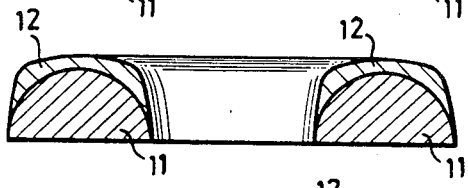

Using the same nickel bath as above, the 2-butyne-1,4-diol concentration is increased to 160 mg/l. At a current density of 5 A/dm$^2$ and with a liquid speed of 1 m/sec., the product obtained after electrolysis for 60 minutes comprises a land section as shown schematically in FIG. 6.

Figure 7:
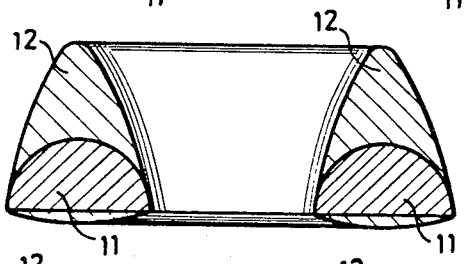

A fresh matrix plate is then fitted and under the same conditions the speed of the liquid is reduced to 0.16 m/sec. resulting in a product with a land section as shown schematically in FIG. 7.

Figure 8:
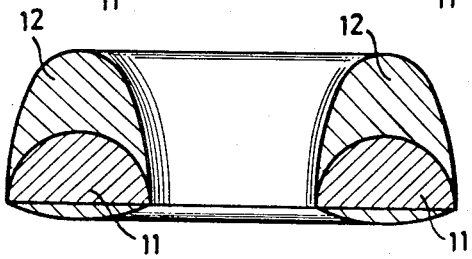

After a new screen plate had been fitted, the above conditions were maintained, but the current density was increased to 10 A/dm$^2$ and the electrolysis period reduced to 30 minutes. The end product as obtained comprised sectional lands as shown in FIG. 8.

EXAMPLE III 0.3 ml of a solution of hydroxypropionitrile as organic compound with an unsaturated bond and presenting second class brightener properties is added to a nickel bath, per liter of bath liquid. 2 G of the sodium salt of benzene metadisulphonic acid are also added per liter of bath liquid.

A portion of the matrix plate as described in the previous tests is subjected to an electrolysis for 30 minutes at a liquid flow of 0.16 m/sec. and a cathode current density of 10 A/dm$^2$, the bath liquid temperature being 60° C.

Figure 9:
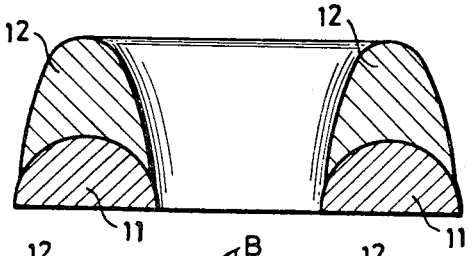

The land section of the resulting end product is shown schematically in FIG. 9.

EXAMPLE IV

A stainless steel piece of screen gauze with aperture in the form of slots of 120 μm wide is placed in a nickel bath to which 80 mg of 2-butyne-1,2-diol, a compound presenting second class brightener properties, has been added.

Figure 10:
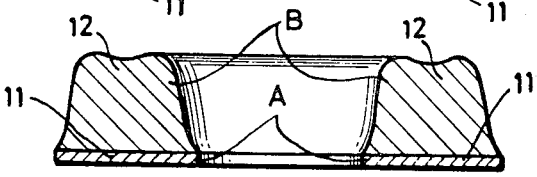

Using a current density of 5 A/dm$^2$ and a liquid speed of 0.16 m/sec., the end product obtained after 60 minutes has the land section shown schematically in FIG. 10.

Part A represents the stainless steel matrix while the hatched part represents the area deposited by electrolysis.

Parts A and B are readily separable by applying a blade to a corner point, whereupon part A is re-used for the same process.

EXAMPLE V

The preceding test is repeated with a cylindrical cathode having 120 μm wide apertures.

The horizontally disposed cathode used as matrix is rotated and partially suspended in the liquid.

The product obtained after 60 minutes has the same properties as the one shown in FIG. 10.

In all the examples the bath liquid is flowing from the anode to the cathode.

What is claimed is:

1. Process of electrolytically manufacturing screen material by depositing a metal upon a sieve-like porous matrix having apertures therethrough, the process comprising:

placing the matrix in an electrolytic bath, the bath containing at least one brightener, connecting the matrix as a cathode, spacing an anode from the cathode, flowing the bath liquid at least during part of the electrolytic deposition, through the apertures in the matrix connected as the cathode and only from the anode toward the cathode.

2. The process of claim 1, wherein the bath liquid is made to flow at a speed of at least 0.005 m/sec.

3. The process of claim 1, wherein the bath liquid is made to flow at a speed in a range of 0.05 to 1 m/sec.

4. The process of claim 1, wherein the forced flow of bath liquid is applied at the start of the electrolysis.

5. The process of claim 1, wherein the bath liquid is made to flow through the apertures in the cathode for a period of less than 10% of the total electrolysis time.

6. The process of claim 1, wherein the cathode current density is adjusted to and maintained at a predetermined value.

7. The process of claim 1, wherein the electrolytic bath contains an organic compound having at least one unsaturated bond not belonging to a

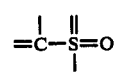

group.

8. The process of claim 1, wherein the electrolytic bath contains a compound presenting second class brightener properties.

9. The process of claim 1, wherein said compound is chosen from the group consisting of a butyne and ethylene cyanohydrin.

10. The process of claim 1, wherein the matrix is given a surface treatment for enabling the electrolytically deposited material to be removed as a screen.

11. The process of claim 1, wherein the matrix is subjected to electrolysis in an electrolytic bath containing an organic compound having at least one double bond not belonging to a

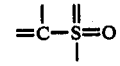

group while a forced flow of liquid takes place through the cathode apertures and perpendicular to the cathode, whereafter, with the cathode current density adjusted to a predetermined value the electrolysis is continued, and thereafter the resulting screen is removed from the matrix.

12. The process of claim 1, wherein the matrix is subjected to electrolysis in an electrolytic bath containing an organic compound having at least one triple bond not belonging to a

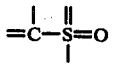

group while a forced flow of liquid takes place through the cathode apertures and perpendicular to the cathode, whereafter, with the cathode current density adjusted to a predetermined value the electrolysis is continued, and thereafter the resulting screen is removed from the matrix.

13. The process of claim 1, wherein the matrix is a cylindrical matrix.

14. Screen material produced by the process of depositing metal from an electrolytic bath upon a sievelike matrix using at least one brightener is the electrolytic bath, wherein the screen material is produced by flowing the bath liquid through the apertures in the cathode-connected matrix, only from the anode toward the cathode during at least a part of the electrolytic metal depositon.

15. The screen material of claim 14, wherein said screen material is obtained by using electrolytic bath a brightener which contains at least one unsaturated bond not belonging to a

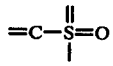

group.

16. The screen material of claim 14, wherein the electrolytic bath contains a compound presenting second class brightener properties.

17. The screen material of claim 14, wherein the bath liquid is made to flow at a speed of at least 0.005 m/sec.

* * * * *